US005921129A

United States Patent [19]

Drigani et al.

[11] Patent Number: 5,921,129

[45] Date of Patent: Jul. 13, 1999

[54] DEVICE FOR THE CROSSED DISPLACEMENT OF ROLLING ROLLS

[75] Inventors: Fausto Drigani, Zugliano/Pozzuolo Del Friuli; Cesare Galletti, Segrate Milano San Felice; Giacinto Dal Pan, Cellatica, all of Italy

[73] Assignee: Danieli & C. Officine Meccaniche SpA, Buttrio, Italy

[21] Appl. No.: 08/880,446

[22] Filed: Jun. 24, 1997

[30] Foreign Application Priority Data

Jun. 24, 1996 [IT] Italy ..... UD96000106

[51] Int. Cl.[6] ..... B21B 31/00

[52] U.S. Cl. ..... 72/237; 72/241.8

[58] Field of Search ..... 72/237, 240, 241.2, 72/241.4, 241.6, 241.8, 242.4, 247

[56] References Cited

U.S. PATENT DOCUMENTS

| | | | |
|---|---|---|---|
| 4,453,393 | 6/1984 | Hino et al. | 72/241.8 |
| 5,291,770 | 3/1994 | Koujin et al. | 72/241.2 |

FOREIGN PATENT DOCUMENTS

| | | | |
|---|---|---|---|
| 233597 | 8/1987 | European Pat. Off. . | |
| 525552 | 2/1993 | European Pat. Off. . | |
| 732157 | 9/1996 | European Pat. Off. . | |
| 744227 | 11/1996 | European Pat. Off. . | |
| 5-38504 | 2/1993 | Japan | 72/237 |
| 5-237524 | 9/1993 | Japan | 72/237 |
| 5-269511 | 10/1993 | Japan | 72/237 |
| 5-317918 | 12/1993 | Japan | 72/241.8 |
| 5-337524 | 12/1993 | Japan | 72/237 |
| 6-31304 | 2/1994 | Japan | 72/241.8 |
| 6-31318 | 2/1994 | Japan | 72/237 |
| 489707 | of 0000 | United Kingdom . | |

OTHER PUBLICATIONS

Patent Abstracts of Japan vol. 007 No. 047 (M–196) Feb. 24, 1983 & JP 57 195513 (Mitsubishi) Dec. 1, 1982—Abstract.

Patent Abstracts of Japan vol. 007 No. 041 (M–194) Feb. 18, 1983 & JP 57 190712 (Mitsubishi) Nov. 24, 1982—Abstract.

Patent Abstracts of Japan vol. 007 No. 047 (M–196) Feb. 24, 1983 & JP 57 195511 (Mitsubishi) Dec. 1, 1982—Abstract.

Research Disclosure, No. 293 Sep. 1, 1988 New York NY USA p. 658 Discl9osed Anonymously "rolling mill stand".

*Primary Examiner*—Joseph J. Hail, III
*Assistant Examiner*—Ed Tolan
*Attorney, Agent, or Firm*—Antonelli, Terry, Stout & Kraus, LLP

[57] ABSTRACT

Device for the crossing of rolling rolls, whether they be working rolls (13) and/or back-up rolls (12), in a four-high rolling mill stand (10) for plate and/or strip, the device including an upper rolling block (11*a*) and a lower rolling block (11*b*), the working rolls (13) and the back-up rolls (12) being supported at the ends by respective supporting chocks (14) associated with stationary housing means (15) defining an inner space to house the chocks (14), cooperating with at least one side of at least one chock (14) there is at least one intermediate positioning element (18) associated with adjustment and positioning means (16), which comprise at least drive means (23) associated with bar means (22) solid with eccentric means (20) by means of arm means (21), the adjustment and positioning means (16) being located in a position outside the stationary housing (15), the eccentric means (20) being associated with rod means (24) which can be moved on their axis and at right angles to the vertical plane of the stand and acting on the intermediate positioning elements (18).

11 Claims, 2 Drawing Sheets

DEVICE FOR THE CROSSED DISPLACEMENT OF ROLLING ROLLS

BACKGROUND OF THE INVENTION

This invention concerns a device for the crossed displacement of rolling rolls, whether they be working rolls and/or back-up rolls, as set forth in the main claim.

To be more exact, the invention is applied in cooperation with the upper and lower rolling blocks of a four-high rolling mill stand for plate and/or strip in order to permit a crossed and coordinated displacement of the working rolls and/or back-up rolls.

Rolling block in this case means the pair formed by the working roll and the back-up roll.

The state of the art covers four-high rolling mill stands for plate and/or strip which include opposed upper and lower working rolls which define the rolling plane and are fitted to the relative chocks located on one side and the other of the rolling mill stand.

Each working roll is associated with a relative back-up roll, the function of which is to limit the bends produced in the working roll during rolling, thus allowing very high rolling pressures to be used.

The state of the art covers the need to induce in the rolls a displacement in the rolling plane which causes a reciprocal crossed positioning of the rolls even though at very limited angles.

In the state of the art, this crossing movement is generally carried out by using two different techniques.

According to a first technique, traversing movements are imparted in a suitable direction to all the chocks supporting the rolls.

In order to achieve the crossed positioning of the rolls, each chock positioned at one end of a roll, for example a working roll, receives a traversing movement in the opposite direction to the movement imparted to the opposite chock of the same working roll and to the movement imparted to the chock at the same end of the opposed working roll.

By using this technique, the vertical projection of the point of intersection of the axes of the rolls remains unchanged for any angle imparted to the axes of the rolls.

According to another displacement technique, by displacing only the opposed chocks located on one side of the roll, while the chocks located on the opposite side are kept stationary, the position of the vertical projection of the point of crossover of the axes of the rolls is varied.

In the state of the art, a plurality of systems to displace the chocks have been proposed, for example with gear systems, screw-threaded systems, jack systems and others.

All these systems however have been found unsatisfactory with regard to accuracy of positioning, coordination of the movements, simplicity of embodiment and application, installation costs and other reasons, among which are the considerable power required, the considerable bending caused, the incorrect functioning of the bearings, etc.

Moreover, these systems known to the state of the art involve very long and laborious inspection and/or maintenance times, both because of their complex embodiments and also because of their positioning, as access is only possible with difficulty, or the maintenance/repair workers can only reach them after preliminary operations of at least partial dismantling of the rolling mill stand, carried out when the plant has been stopped, with all the technical and economic problems which that causes.

Another disadvantage is that devices known to the state of the art do not always manage to guarantee with maximum accuracy and in the long term the absolute equality of the crossing movements of the back-up roll and the relative working roll, for example due to different wear of the relative moving parts.

EP-A-0525552 describes a device which employs a plate, shaped like an inclined plane and vertically movable, which displaces intermediate blocks which are also shaped like an inclined plane at the sides, which in turn displace sideways the chocks of the back-up rolls or of the working roll/back-up roll combined.

This solution, although useful, requires a great force from the motor which moves the outer plates vertically, since it is necessary to transform the vertical movement of the outer plates into sideways movement on a horizontal plane of the intermediate blocks and therefore of the chocks.

Moreover, the sliding of the inclined plane surfaces involves a great deal of wear and therefore frequent maintenance is required or, if such maintenance is not performed, there is a deterioration in the accuracy of positioning.

EP-A-233597 describes a mechanism to laterally displace the working roll with respect to the relative back-up rolls or the intermediate rolls.

According to this system, the working rolls are not crossed over with respect to each other, they are displaced in the same direction so as to modify or regulate the offset and obtain a misalignment between the median vertical planes of the working rolls and the median vertical planes of the back-up or intermediate rolls.

SUMMARY OF THE INVENTION

The present applicants have designed, tested and embodied this invention to overcome the shortcomings of the state of the art and to provide further advantages.

The purpose of this invention is to provide a device to obtain the pair-crossing of rolling rolls which is simple in its construction and functioning, and is able to displace the rolling rolls in a precise, controlled and coordinated manner.

A further purpose of the invention is to provide a device which makes it possible to carry out simple and quick operations of inspection, maintenance and calibration, and to perform these operations even when the rolling mill stand continues to operate.

The device according to the invention has intermediate positioning elements in the space between the supporting chock of the rolls and the outer stationary housing of the rolling mill stand.

These intermediate positioning elements are associated with adjustment and positioning means suitable to determine displacements on a substantially parallel plane to the rolling plane.

According to the invention, the adjustment and positioning means are located in a position outside the stationary housing and therefore are easily accessible for workers. This makes it possible to carry out simple and rapid operations of inspection, maintenance and calibration, and also to simplify the structure considerably, to improve the accuracy of positioning and the coordination of the movements, and moreover to reduce installation costs.

According to the invention, the adjustment and positioning means are irreversible eccentric means and cooperate with actuation arm means governed by motor means.

In a preferred embodiment of the invention, the adjustment and positioning means are included on both fronts of the rolling mill stand and act on both ends of the rolling rolls.

According to a variant, the adjustment and positioning means are included on only one front of the rolling mill stand and act on only one end of the rolls.

The adjustment and positioning means can moreover act simultaneously on both outer faces of the chocks or, according to a variant, only on one outer face of each chock.

The adjustment and positioning means have calibration means which make it possible to put the reciprocal displacements of the rolls in step.

According to a variant, the eccentric means or the intermediate positioning elements or the arm elements have clamping means which make it possible to clamp the rolls temporally in any crossover position whatever in order to release the adjustment and positioning means so as to carry out maintenance operations.

According to another variant, between the intermediate positioning elements and the stationary housing of the rolling mill stand there are compensation means able to prevent unwanted deformations and to compensate for any possible play.

According to the invention, the adjustment and positioning means act on the intermediate positioning elements in such a way that a first side of a first chock of a first roll is displaced in a certain direction and at the same time the opposite side of the same first chock receives a coordinated movement in the opposite direction.

At the same time, the second end of the first roll is subjected to coordinated movements, of an opposite direction to those imparted to the corresponding sides of the first end.

At the same time that these movements are imparted to the first roll, the second roll placed on the opposed rolling block is subjected to coordinated movements, of an opposite direction to the movements imparted to the corresponding ends of the first roll.

According to a first embodiment of the invention, the upper back-up roll and working roll and the lower back-up roll and working roll cooperate respectively with a first, upper pair and a second, lower pair of intermediate positioning elements.

According to another embodiment of the invention, the working rolls and the back-up rolls of the same rolling block cooperate with respective intermediate positioning elements.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

Figure 2:
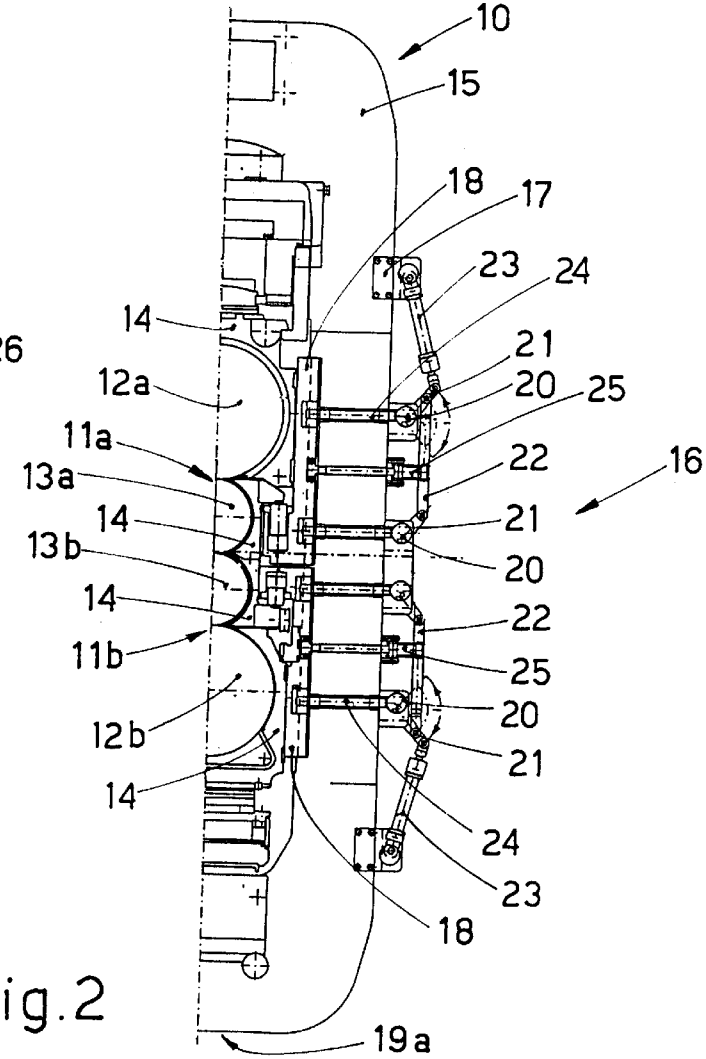
FIG. 2 is a part view of a variant of FIG. 1.

The rolling mill stand 10 for plate and/or strip, of which a front front 19*a* is shown in FIGS. 1–4, has an upper rolling block 11*a* and a lower rolling block 11*b* defining the rolling plane.

Each block, both the upper block 11*a* and the lower block 11*b,* comprises a respective working roll 13 and a respective back-up roll 12, respectively 13*a* and 12*a* for the upper block 11*a,* and 13*b* and 12*b* for the lower block 11*b,* whose ends are associated with the respective supporting chocks 14.

The rolling mill stand 10 includes also a supporting stationary housing 15 defining an inner space to house the chocks 14.

In cooperation with the outer periphery of the stationary housing 15 there are adjustment and positioning means 16, in cooperation, in the case shown here, with both sides of the chocks 14.

These adjustment and positioning means 16 are used to impart to the chocks 14 a movement of coordinated lateral displacement, on a substantially parallel plane to the rolling plane, in order to induce a reciprocal crossover position, one to the other, at least of the working rolls 13.

In this case, the adjustment and positioning means 16 comprise an intermediate plate-type positioning element 18 arranged in contact with the chocks 14 and included in the gap between the chocks 14 and the inner face of the stationary housing 15.

The adjustment and positioning means 16 induce on the plate-type positioning elements 18 movements which determine a mating lateral displacement of the chocks 14.

In this case, the adjustment and positioning means 16 have the configuration of a connecting rod/crank and comprise irreversible eccentric means 20 connected to arms 21 associated with actuation bars governed by jacks 23, solidly mounted on the stationary housing 15 by means of supports 17.

The first arm 21 associated with the upper back-up roll 12*a* is directly connected to the relative jack 23, whereas the other arms 21 are acted on by the vertical movement of the actuation bar 22 solid with the first arm 21.

The point of connection between the jack 23 and the first arm 21 is displaced outwards with respect to the plane on which the centres of the eccentric means 20 lie, in such a way as to reduce the force required from the jack 23 to move the intermediate positioning elements 18 sideways.

The circumferential displacements imparted to the arms 21 by the vertical movements of the actuation bars 22 are transformed by the irreversible eccentric means 20 into horizontal rectilinear movements of the rods 24 which are solidly attached to the plate-type positioning elements 18.

Appropriate sliding and guide means 25 facilitate the vertical movements of the actuation bars 22 and thus prevent unwanted deformations and eliminate and/or compensate for any possible play.

The irreversible eccentric means 20 have their axis 16 parallel to the nominal horizontal axis of the rolls 12–13.

According to a variant, not shown here, the irreversible eccentric means 20 have their axis vertical and substantially at right angles to the nominal horizontal axis of the rolls 12–13.

The eccentric means are configured in such a way as to induce a coordinated movement such that the positioning of the plate-type positioning element 18 on one side of the chock 14 corresponds to a mating positioning in the other direction of the other plate-type positioning element 18 on the other side of the chock 14.

Moreover, according to this configuration the plate-type positioning elements 18*a* of the upper block 11*a* receive a movement in the opposite direction to that imparted to the plate-type positioning elements 18*b* of the lower block 11*b*, causing the desired crossed positioning of the rolls.

Figure 1:
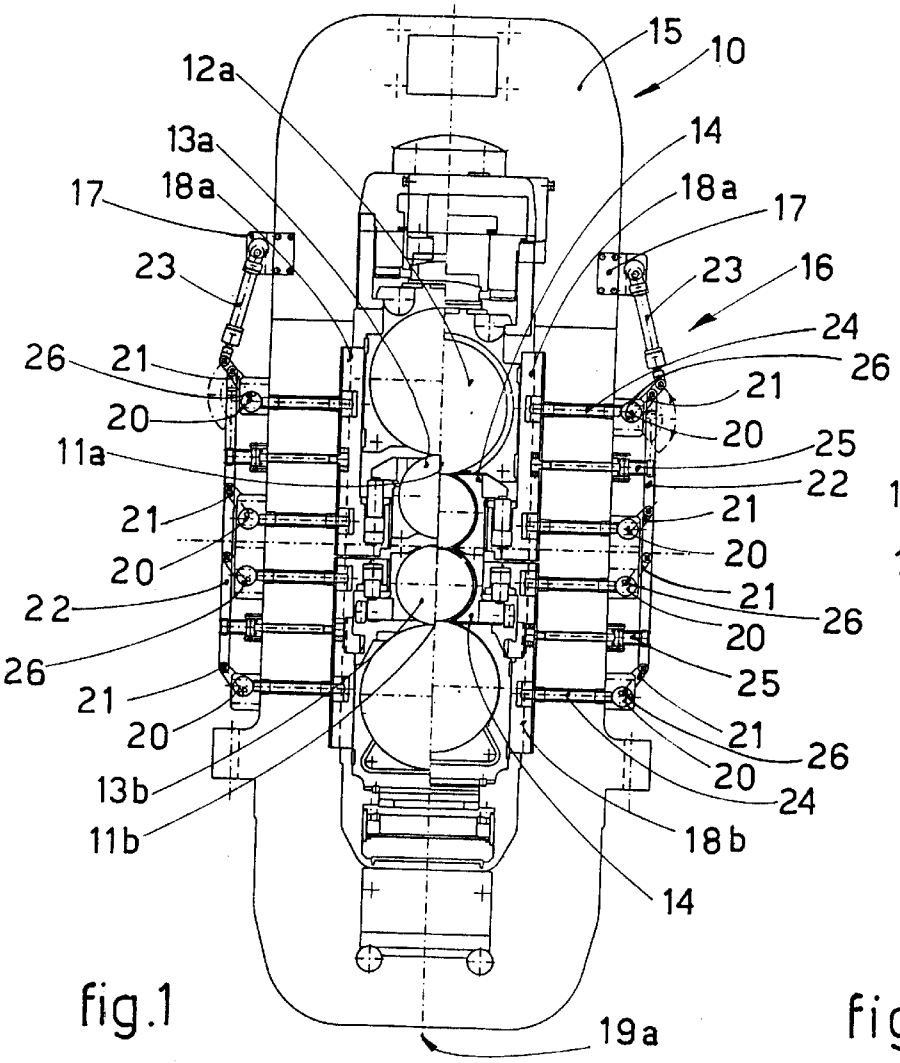
FIG. 1 shows a front view of a rolling mill stand using the device according to the invention.

In the case shown in FIG. 1, the upper block 11*a* and the lower block 11*b* are associated, for each front of the rolling mill stand 10, with a single jack means 23 connected to a respective actuation bar 22 which induces an opposite displacement of the elements of the upper block 11*a* compared with the elements of the lower block 11*b*.

This is because, referring to the same side of the rolling stand 10, the arms 21 are anchored to the eccentric means 20 in points 26 which are diametrically opposed, arranged at 180° from each other, between the upper block 11*a* and the lower block 11*b*.

In a similar way, the points of connection 26 between the arms 21 and the eccentric means 20 of opposite sides of the same chock 14 are arranged diametrically opposed.

In FIG. 2, each rolling block, both the upper 11*a* and the lower 11*b*, cooperates with a respective jack means 23, being the connection between the arms 21 and their relative eccentric means 20 of the upper rolling block 11*a* specular in respect of the lower rolling block 11*b* always referring to the same side of the rolling stand 10.

Figure 3:
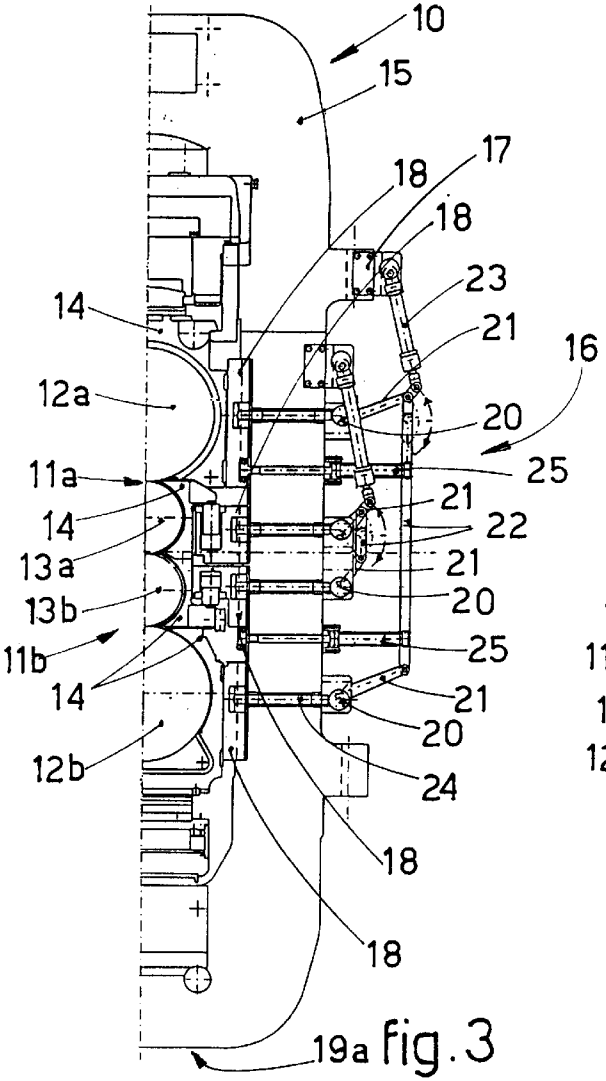
FIG. 3 is a part view of another variant of FIG. 1.

In FIG. 3, the plate-type positioning elements 18 associated with the back-up rolls 12*a*, 12*b* are controlled by the same jack 23 by means of an actuation bar 22 associated with arms 21 connected to eccentric means 20 with diametrically opposed anchorage points; the working rolls 13*a*, 13*b* are associated with another jack 23 which is also connected to its own actuation bar 22 associated with irreversible eccentric means 20 with diametrically opposed anchorage points.

This embodiment makes it possible to manage in a differentiated though coordinated manner the displacement of the working rolls 13*a*, 13*b* in relation to the displacement of the back-up rolls 12*a*, 12*b*.

Figure 4:
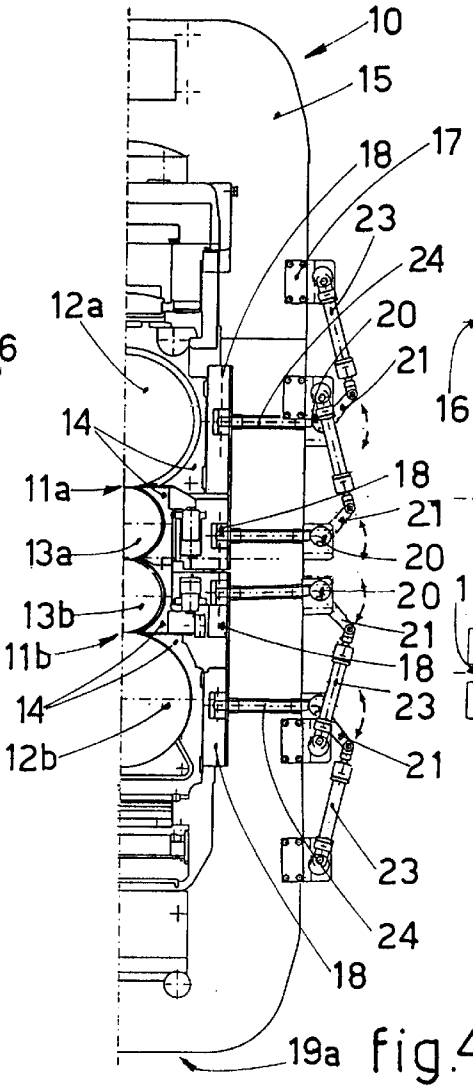
FIG. 4 is a part view of another variant of FIG. 1.

According to the embodiment shown in FIG. 4, for each roll 12 and 13 there is a displacement means comprising at least one jack 23 which is directly associated with the eccentric means 20 by means of the arms 21, in this case too being specular the connection between the arms 21 and the eccentric means 20 in the upper block 11*a* and in the lower block 11*b*.

Figure 5:
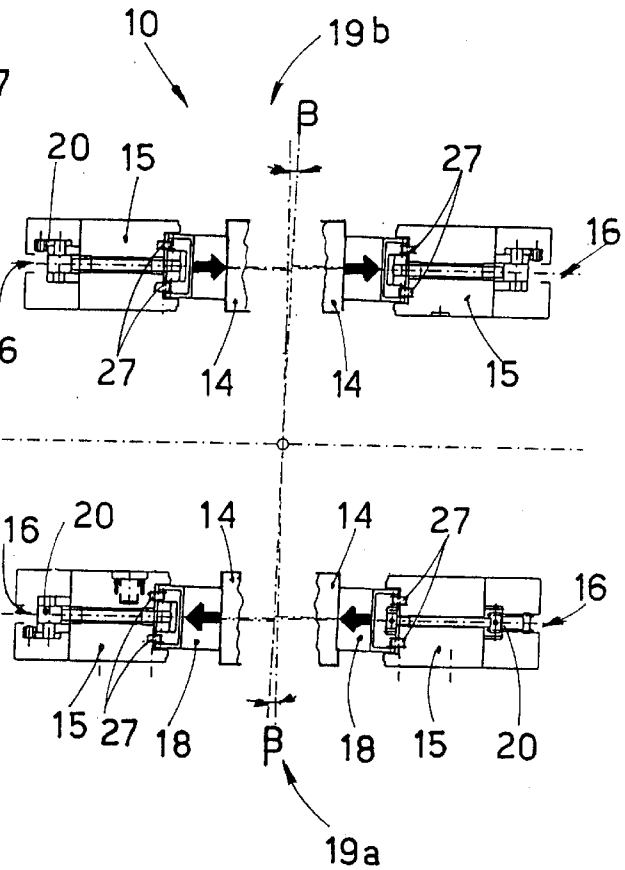
FIG. 5 is a plane view in part section, with particular reference to the device according to the invention, of the rolling mill stand shown in FIG. 1–4.

In this case, as shown in FIG. 5, the position of one of any of the rolling rolls 12–13 is adjusted both on the front front 19*a* and on the rear front 19*b* according to the desired angles β, both these fronts 19*a* and 19*b* comprising adjustment and positioning means 16 associated with both the outer sides of the stationary housing 15.

According to a variant, the position is adjusted only on one front 19*a*, or 19*b*, of the rolling mill stand 10.

According to another variant, between each plate-type positioning element 18 and the stationary housings 15 there may be included hydraulic capsules 27 in order to distribute the thrusts and loads, preventing unwanted deformations and compensating any play caused by the tolerances between the parts in reciprocal movement.

The actuation arms 22 have calibration means (not shown here) which make it possible to independently adjust the back-up rolls and working rolls of the same rolling block or between the opposed rolling blocks.

We claim:

1. Device for the crossing of rolling rolls, whether they be working rolls and/or back-up rolls, in a four-high rolling mill stand for plate and/or strip, the device including an upper rolling block and a lower rolling block, the working rolls and the back-up rolls being supported at the ends by respective supporting chocks associated with stationary housing means defining an inner space to house the chock, the device being characterised in that in cooperation with at least one side of at least one chock there is at least one intermediate positioning element associated with adjustment and positioning means, which comprise at least drive means connected with eccentric means by means of arm means, the adjustment and positioning means being located in a position outside the stationary housing, the eccentric means being associated with rod means which can be moved on their axis and at right angles to the vertical plane of the stand and acting on the intermediate positioning elements.

2. Device as in claim 1, in which the connection between the eccentric means and the relative arm means is specular, for each side of the four-high rolling stand, between the upper block and the lower block.

3. Device as in claim 1, in which the axis of the eccentric means is parallel to the axis of the rolling rolls.

4. Device as in claim 1, in which the axis of the eccentric means is at a right angle to the axis of the rolling rolls.

5. Device as in claim 1, in which the actuating means are jack system means.

6. Device as in claim 5, in which the jack means are directly connected to the first arm associated with the upper back-up roll and, by means of the bar means, to the other arms, the connection between the jack means and the first arm being arranged outside the vertical plane passing through the centres of the eccentric means.

7. Device as in claim 1, in which the adjustment and positioning means are located on only one side of the stationary housing.

8. Device as in claim 1, in which the adjustment and positioning means are located on both sides of the stationary housing.

9. Device as in claim 1, in which the intermediate positioning elements cooperate with hydraulic capsule means to compensate for any play.

10. A four-high rolling mill stand for plate and/or strip, comprising:

a stationary housing;

an upper rolling block and a lower rolling block, each of the upper rolling block and lower rolling block comprising a working roll and a back-up roll supported at their ends in an interior space in the stationary housing with chocks;

an intermediate positioning element connected to at least one side of at least one chock;

at least one rod movable at right angles to a vertical plane of the stand and connected at one end to the intermediate positioning element and having another end outside the housing;

at least one eccentric element connected to another end of the at least one rod for transferring rotational movement of the at least one eccentric element to rectilinear movement of the at least one rod at right angles to the vertical plane of the stand; and an actuator element for providing rotational movement to the at least one eccentric element.

11. Device as in claim 1, further comprising bar means connecting the drive means to a plurality of eccentric means, each of the plurality of eccentric means being associated with rod means which can be moved on their axes and at right angles to the vertical plane of the stand and acting on the intermediate positioning elements.

* * * * *